US010453641B2

(12) United States Patent
Choi et al.

(10) Patent No.: US 10,453,641 B2
(45) Date of Patent: Oct. 22, 2019

(54) MAGNETRON HAVING ENHANCED HARMONICS SHIELDING PERFORMANCE

(71) Applicant: LG ELECTRONICS INC., Seoul (KR)

(72) Inventors: Heung Sik Choi, Seoul (KR); Sung-Hun Sim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/271,385

(22) Filed: Feb. 8, 2019

(65) Prior Publication Data

US 2019/0252147 A1 Aug. 15, 2019

(30) Foreign Application Priority Data

Feb. 9, 2018 (KR) ..... 10-2018-0015996

(51) Int. Cl.
*H01J 23/54* (2006.01)
*H01J 25/54* (2006.01)

(52) U.S. Cl.
CPC ..... *H01J 23/54* (2013.01); *H01J 25/54* (2013.01)

(58) Field of Classification Search
CPC .. H01J 23/10; H01J 23/15; H01J 23/54; H01J 25/50; H01J 25/587; H05B 6/6402; H05B 6/705; H05B 6/72
See application file for complete search history.

(56) References Cited

U.S. PATENT DOCUMENTS 4,338,545 A * 7/1982 Koinuma ..... H01J 23/10 313/151
4,752,720 A * 6/1988 Oguro ..... H01J 23/15 315/39

(Continued)

FOREIGN PATENT DOCUMENTS

EP 0205316 12/1986
EP 0426130 5/1991

(Continued)

OTHER PUBLICATIONS

Extended European Search Report in European Application No. 19156351.9, dated Jun. 21, 2019, 8 pages.

*Primary Examiner* — Haissa Philogene
(74) *Attorney, Agent, or Firm* — Fish & Richardson P.C.

(57) ABSTRACT

A magnetron includes a yoke, an upper magnet, an upper pole piece located at a lower side of the upper magnet, a fifth-harmonic-frequency choke located at an upper side of the upper pole piece, a third-harmonic-frequency at a lower side of the fifth-harmonic-frequency choke, a ceramic part located at an upper end of the fifth-harmonic-frequency choke and configured to output an electromagnetic wave including a plurality of frequencies, a fourth-harmonic-frequency choke that is bent inward from the ceramic part and that is welded to an upper end of the ceramic part, and a second-harmonic-frequency choke that is welded to the fourth-harmonic-frequency choke and that extends upward and downward along a heightwise direction. The third-harmonic-frequency choke, fifth-harmonic-frequency choke, and second-harmonic-frequency choke are configured to block harmonic frequencies of the electromagnetic wave.

20 Claims, 9 Drawing Sheets

(56) References Cited

U.S. PATENT DOCUMENTS

| | | | | |
|---|---|---|---|---|
| 5,180,946 | A * | 1/1993 | Aiga | H01J 23/54 315/39.51 |
| 6,774,568 | B2 * | 8/2004 | Yang | H01J 23/10 315/39.51 |
| 7,148,627 | B2 * | 12/2006 | Ishii | H01J 23/54 315/39.51 |
| 7,511,251 | B2 * | 3/2009 | Baek | H01J 23/54 219/736 |

FOREIGN PATENT DOCUMENTS

| | | | |
|---|---|---|---|
| EP | 1594152 | | 11/2005 |
| JP | 2017-174762 | A | 9/2017 |
| KR | 20-0150804 | U | 7/1999 |
| KR | 10-2004-0106151 | | 12/2004 |

* cited by examiner

MAGNETRON HAVING ENHANCED HARMONICS SHIELDING PERFORMANCE

CROSS-REFERENCE TO RELATED APPLICATION

This application claims priority under 35 U.S.C. § 119 to Korean Application No. 10-2018-0015996, filed on Feb. 9, 2018, which is herein incorporated by reference in its entirety.

TECHNICAL FIELD

This application relates to a magnetron having enhanced harmonic frequencies shielding performance.

BACKGROUND

A magnetron is a device that may be installed in a microwave oven, lighting device, and the like, and that may convert electric energy into high-frequency energy such as a microwave.

The magnetron may output, based on oscillation, electromagnetic waves with high frequencies, for example, at a 2.45 GHz fundamental frequency, and may generate harmonic frequencies, for example, at frequencies twice, three times, . . . , N times of the fundamental frequency, where N represents natural numbers.

In some cases, a magnetron may operate with methods for shielding (removing or minimizing) harmonic frequencies as well as the fundamental frequency.

For example, a magnetron may include four chokes in an output unit thereof that may shield second, third, fourth and fifth harmonic frequencies with a high level of noise intensity (intensity of harmonic frequencies).

FIG. 1 is a sectional view of a magnetron including four chokes in related art.

As shown in FIG. 1, the magnetron may include four chokes (CK2, CK3, CK4, and CK5), and the second to fifth harmonic frequency chokes (CK2 to CK5) may shield second to fifth harmonic frequencies respectively.

In some cases, a short circuit or a spark may occur in the second-harmonic-frequency choke (CK2) due to a short distance between the second-harmonic-frequency choke (CK2) and an antenna feeder (AF). The short circuit may be related to the electromagnetic structure.

In some cases. the chokes may be lengthened to improve the function of shielding harmonic frequencies. In some cases, a second-harmonic-frequency choke (CK2) may be limited in lengthening due to the interference between an antenna feeder (AF) and the second-harmonic-frequency choke (CK2).

In some case, the harmonic shielding performance of a second-harmonic-frequency choke (CK2) may be worse that of the other harmonic frequency chokes (third to fifth harmonic frequency chokes (CK3, CK4, and CK5)).

SUMMARY

The present disclosure describes a magnetron having enhanced harmonic shielding performance.

The present disclosure describes a magnetron configured to prevent or avoid the interference between chokes and an antenna feeder.

The objects of the present disclosure are not limited to what has been mentioned. Other objects and advantages that have not been mentioned may be understood from the following description and implementations. Further, it will be apparent that the objects and advantageous may be embodied via means and combinations thereof in the appended claims.

According to one aspect of the subject matter described in this application, a magnetron includes: a yoke that defines an accommodating space and that defines a yoke opening at an upper portion of the yoke; an upper magnet located in the accommodating space and coupled to an inner surface of the upper portion of the yoke along a widthwise direction of the yoke; an upper pole piece that has a funnel shape and that is located at a lower side of the upper magnet; a fifth-harmonic-frequency choke that is located in the yoke opening, that is located at an upper side of the upper pole piece, and that is configured to block a fifth harmonic frequency from an electromagnetic wave; a third-harmonic-frequency choke that is located in the yoke opening, that is located at a lower side of the fifth-harmonic-frequency choke, and that is configured to block a third harmonic frequency from the electromagnetic wave; a ceramic part located at an upper end of the fifth-harmonic-frequency choke and configured to output the electromagnetic wave including a plurality of frequencies; a fourth-harmonic-frequency choke that is bent inward from the ceramic part, that is welded to an upper end of the ceramic part, and that is configured to block a fourth harmonic frequency from the electromagnetic wave; and a second-harmonic-frequency choke that is welded to the fourth-harmonic-frequency choke, that extends upward and downward along a heightwise direction, and that is configured to block a second harmonic frequency from the electromagnetic wave.

Implementations according to this aspect may include one or more of the following features. For example, the yoke may include an upper yoke that defines the yoke opening, and a lower yoke that is coupled to the upper yoke, where the upper yoke and the lower yoke define the accommodating space based on being coupled to each other. In some examples, the magnetron may further include a lower magnet accommodated in the accommodating space and coupled to an inner surface of the lower yoke along the widthwise direction of the yoke, where the upper magnet is coupled to an inner surface of the upper yoke.

In some implementations, the magnetron may further include: an anode cylinder that has an upper opening and a lower opening, that is located in a space between the upper magnet and the lower magnet, and that is configured to generate high-frequency energy; a lower pole piece that has a funnel shape and that is located at an upper side of the lower magnet; and an antenna cap located at the upper end of the ceramic part, where the upper pole piece is located at the upper opening of the anode cylinder, and the lower pole piece is located at the lower opening of the anode cylinder.

In some implementations, the magnetron may further include: an anode cylinder located in the yoke; a plurality of vanes radially that are arranged in the anode cylinder and that defines a cavity resonator configured to induce a high-frequency component of the electromagnetic wave; and an antenna located at the fifth-harmonic-frequency choke and configured to, based on oscillation of the electromagnetic wave in the cavity resonator, output the electromagnetic wave including the plurality of frequencies. In some examples, the antenna has a lower end connected to one of the plurality of vanes, and an upper end fixed to an inner surface of an upper portion of the second-harmonic-frequency choke.

In some implementations, the fifth-harmonic-frequency choke includes a bent part that is bent inward from an upper end of the fifth-harmonic-frequency choke and that extends downward along the heightwise direction. In some examples, the third-harmonic-frequency choke extends along the heightwise direction, is coaxial with the bent part, and is arranged outside of the bent part. In some implementations, the ceramic part is brazed to the upper end of the fifth harmonic frequency choke, where the fourth-harmonic-frequency choke is brazed to the ceramic part, and the second-harmonic-frequency choke is brazed to the fourth-harmonic-frequency choke.

In some examples, the third-harmonic-frequency choke is configured to block a third bandwidth of frequency, the fourth-harmonic-frequency choke is configured to block a fourth bandwidth of frequency that is greater than the third bandwidth, the fifth-harmonic-frequency choke is configured to block a fifth bandwidth of frequency that is greater than the fourth bandwidth, and the second-harmonic-frequency choke is configured to block a second bandwidth of frequency that is greater than the fifth bandwidth.

In some cases, a length of the second-harmonic-frequency choke is in a range from 14 mm to 16 mm in the heightwise direction. In some examples, a lower end of the third-harmonic-frequency choke is located vertically above a lower end of the upper magnet. In some cases, a length of the third-harmonic-frequency choke is less than a length of the upper magnet in the heightwise direction. In some cases, a length of the third-harmonic-frequency choke is less than a length of the lower magnet in the heightwise direction.

In some implementations, the plurality of frequencies include a fundamental frequency that is a half of the second harmonic frequency. In some examples, the third harmonic frequency is three times of the fundamental frequency, the fourth harmonic frequency is four times of the fundamental frequency, and the fifth harmonic frequency is five times of the fundamental frequency.

According to another aspect, a magnetron includes: a yoke that defines an accommodating space and that defines a yoke opening at an upper portion of the yoke; an upper magnet located in the accommodating space and coupled to an inner surface of the upper portion of the yoke along a widthwise direction of the yoke; an upper pole piece that has a funnel shape and that is located at a lower side of the upper magnet; a fifth-harmonic-frequency choke that is located in the yoke opening, that is located at an upper side of the upper pole piece, and that is configured to block a fifth harmonic frequency from an electromagnetic wave; a ceramic part located at an upper end of the fifth-harmonic-frequency choke and configured to output the electromagnetic wave including a plurality of frequencies; a third-harmonic-frequency choke that is bent inward from the ceramic part, that is welded to an upper end of the ceramic part, and that is configured to block a third harmonic frequency from the electromagnetic wave; and a second-harmonic-frequency choke that is welded to the third-harmonic-frequency choke, that extends upward and downward along a heightwise direction, and that is configured to block a second harmonic frequency from the electromagnetic wave.

Implementations according to this aspect may include one or more of the following features. For example, the third-harmonic-frequency choke is configured to block a third bandwidth of frequency, the fifth-harmonic-frequency choke is configured to block a fifth bandwidth of frequency that is greater than the third bandwidth, and the second-harmonic-frequency choke is configured to block a second bandwidth of frequency that is greater than the fifth bandwidth.

Below, the above-described effects and the effects of the present disclosure will be described in the description of the details of example implements of the present disclosure.

DETAILED DESCRIPTION

Figure 1:
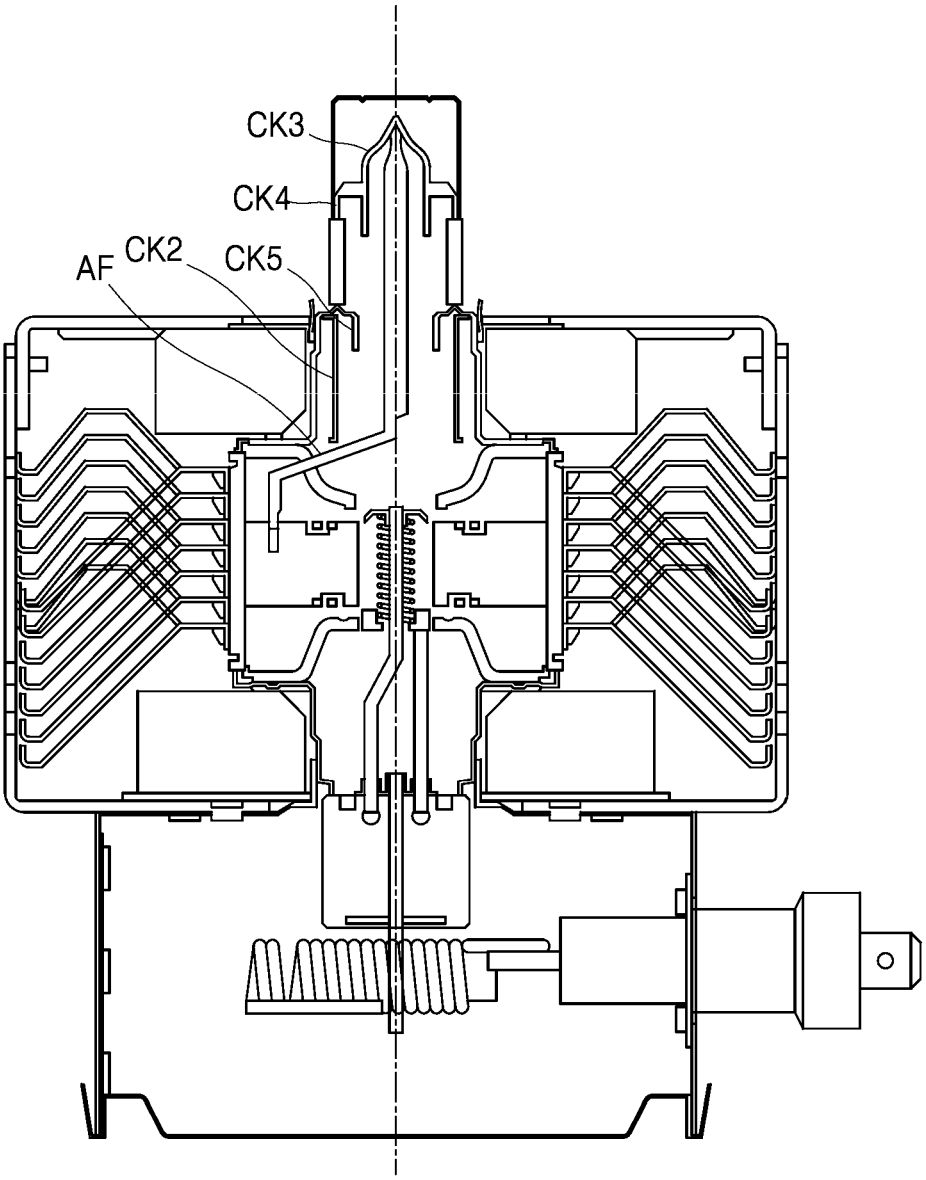
FIG. 1 RELATED ART
FIG. 1 is a sectional view showing a magnetron in related art.

Below, exemplary implementations of will be described with reference to the attached drawings. In the drawings, like reference numerals denote like elements.

Figure 2:
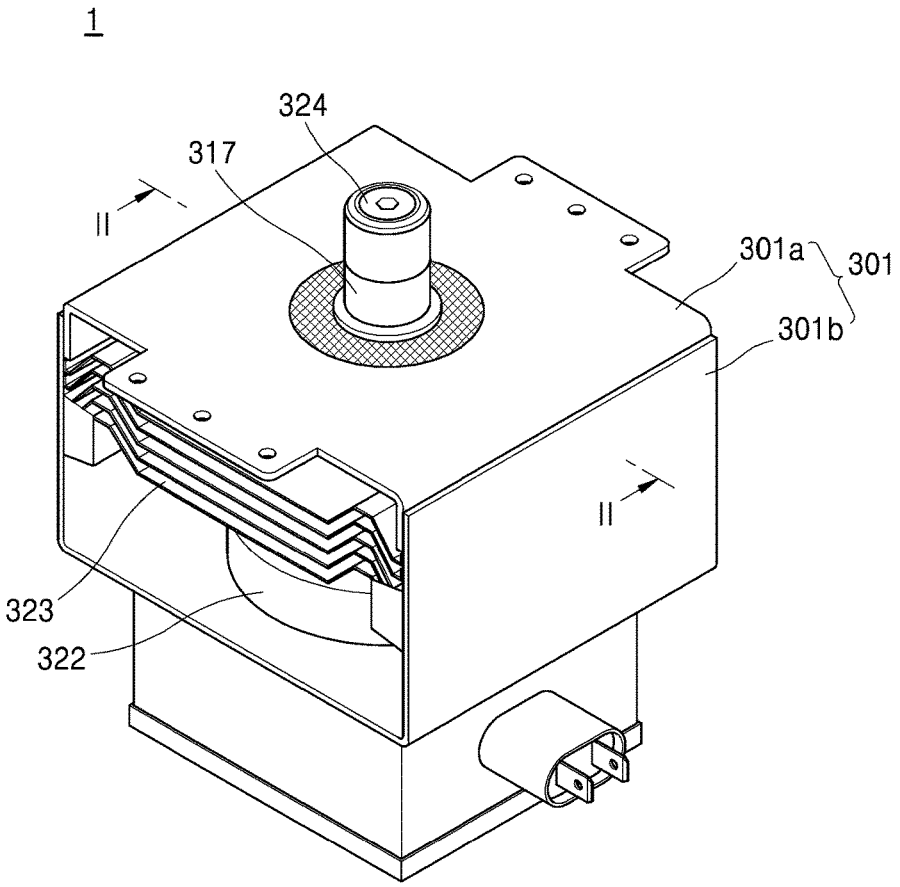
FIG. 2 is a perspective view showing an example magnetron according to the present disclosure.
Figure 3:
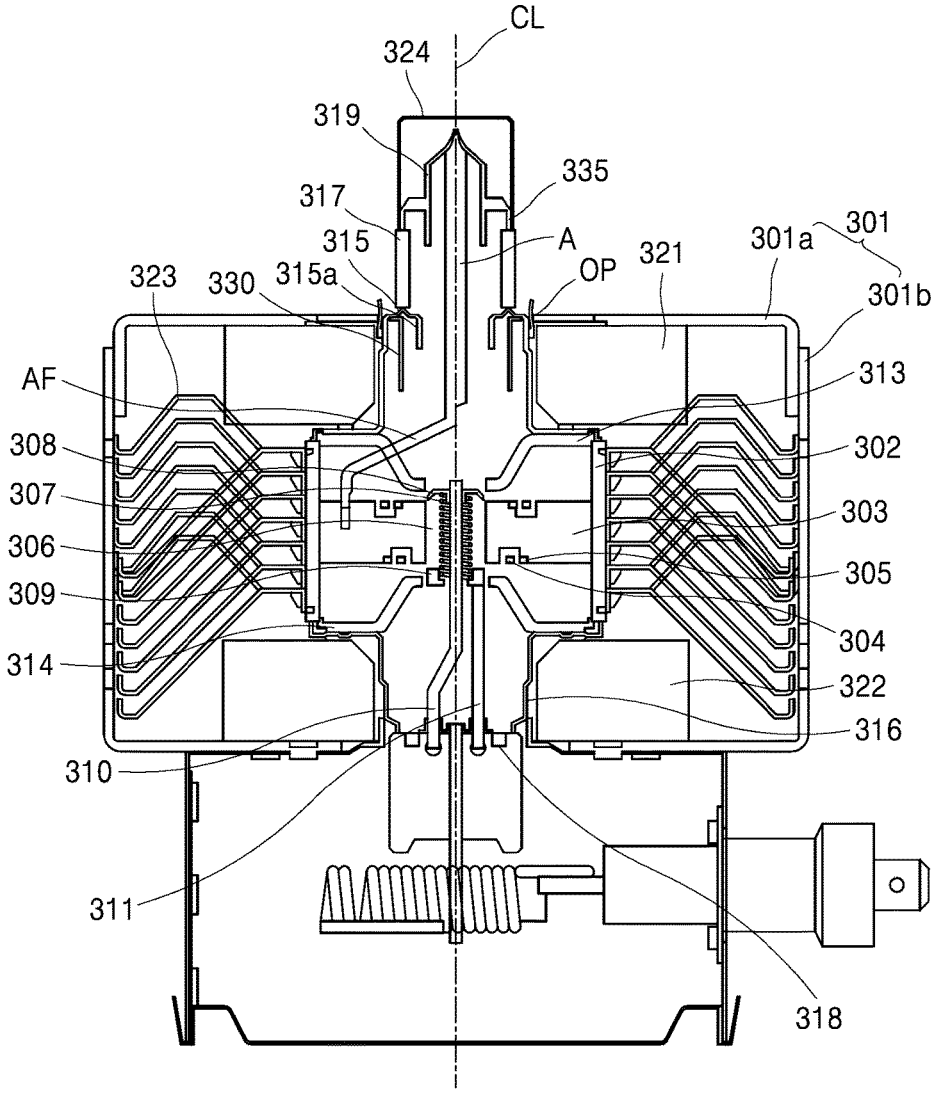
FIG. 3 is a sectional view showing the magnetron cut along II-II in FIG. 2.

FIG. 2 is a perspective view showing an example magnetron according to the present disclosure, and FIG. 3 is a sectional view showing the magnetron cut along "II-II" in FIG. 2.

With reference to FIGS. 2 and 3, a magnetron 1 may include a yoke 301, an upper magnet 321, a lower magnet 322, an anode cylinder 320, an upper pole piece 313, a lower pole piece 314, a ceramic part 317 (e.g., A-ceramic), a second-harmonic-frequency choke 319 (e.g., exhaust pipe), a third-harmonic-frequency choke 330, a fourth-harmonic-frequency choke 335, a fifth-harmonic-frequency choke 315 (e.g., A-seal), an antenna cap 324, a plurality of vanes 303, an antenna (A), an antenna feeder (AF) and the like.

In some examples, the A-seal may be a harmonic-frequency choke having an "A" shape in a sectional view (see FIG. 3). The A-ceramic may be a ceramic part brazed to an upper side of the A-seal 315 for outputting high frequencies outward.

The yoke 301 may have an accommodating therein and an opening (OP) at an upper portion thereof.

Specifically, the yoke 301 may include an upper yoke 301*a* having the opening (OP) and a lower yoke 301*b* coupled to the upper yoke 301*a* so as to form the accommodating space.

An upper magnet 321 may be accommodated in the accommodating space of the yoke 301 and fixedly coupled to an inner surface of an upper portion of the yoke 301 along a widthwise direction thereof (i.e., left-right direction or horizontal direction).

Specifically, the upper magnet 321 may be fixedly coupled to an inner surface of the upper yoke 301*a*.

A lower magnet 322 may be accommodated in the accommodating space of the yoke 301 and fixedly coupled to an inner surface of a lower portion of the yoke 301 along a width direction thereof.

Specifically, the lower magnet 322 may be fixedly coupled to an inner bottom surface of the yoke 301*b*.

The anode cylinder 302 may be arranged in a space between the upper magnet 321 and the lower magnet 322 and generate high-frequency energy.

Specifically, the anode cylinder 302 may be installed in the yoke 301, in which the upper yoke 301*a* and the lower yoke 301*b* are coupled and the lateral cross section of which has a rectangular shape, and have a cylinder shape.

In some implementations, a plurality of vanes 303 having a cavity resonator for inducing high-frequency elements may be arranged in the anode cylinder 302.

Herein, the plurality of vanes 303 may be radially arranged in the anode cylinder 302, and such a radial form may be implemented in a central direction (the direction of a central axis). An interior ring for equal pressure 304 and an exterior ring for equal pressure 305 are alternately connected and coupled respectively to upper and lower front ends of the plurality of vanes 303 so as to form an anode together with the anode cylinder 302.

In some implementations, a spirally wound filament 307 may be installed on a central axis of the anode cylinder 302 so that an operation space 306 spaced apart from the front ends of the vanes 303 can be formed.

The filament 307 is a mixture of tungsten and thoria and includes a cathode heated by action current supplied to the filament 307 and emitting thermal electrons. In some implementations, a top shield 308 may be fixed to an upper end of the filament 307 so as to prevent the discharged thermal electrons from being emitted upward while an end shield 309 may be fixed to a lower end of the filament 307 so as to prevent the discharged electrons from being emitted downward. In some implementations, a center lead 310 consisting of molybdenum is inserted into a through hole formed at a central portion of the end shield 309 and is welded to the top shield 308, and an upper end of a side lead 311 spaced apart from the center lead 310 and consisting of molybdenum is welded to a lower surface of the end shield 309.

In some examples, the upper pole piece 313 and the lower pole piece 314 may be coupled to upper and lower openings of the anode cylinder 320, respectively.

Specifically, the upper pole piece 313 may be installed at a lower side of the upper magnet 321 and have a funnel shape. In some implementations, the upper pole piece 313 may be arranged at the upper opening of the anode cylinder 302, and a cylinder-shaped A-seal 315 (fifth harmonic frequency choke) may be brazed to an upper end of the upper pole piece 313 so as to shield a fifth harmonic frequency.

In some implementations, the lower pole piece 314 may be installed at an upper side of the lower magnet 322, have a funnel shape and be arranged at the lower opening of the anode cylinder 302. In some implementations, a cylinder-shaped F-seal 316 may be brazed to a lower end of the lower pole piece 314 so as to shield a fifth harmonic frequency. In some examples, the F-seal 316 may be a harmonic-frequency choke having an "F" shape in a sectional view (see FIG. 3).

The A-seal 315 may be installed at the opening (OP) of the upper yoke 301*a* placed at an upper side of the upper pole piece 313.

Specifically, the A-seal 315 may be the fifth-harmonic-frequency choke for shielding a fifth harmonic frequency and include a bent part 315*a* bent inward at an upper end of the A-seal 315 and extending downward along a heightwise direction (i.e., up-down direction or vertical direction).

In some examples, the A-seal 315 may have a closed section and shield a fifth harmonic frequency.

In some implementations, an antenna (A) for outputting high frequencies induced in a cavity resonator may be installed in the A-seal 315. Herein, a lower end of the antenna (A) may be connected to the plurality of vanes 303 while an upper end of the antenna (A) may be fixed to a top surface in the second-harmonic-frequency choke 319 (exhaust pipe).

In some implementations, an A-ceramic 317 for outputting high frequencies outward may be brazed to an upper side of the A-seal 315 while an F-ceramic 318 for hot rolling may be brazed to a lower side of the F-seal 316. In some examples, the F-ceramic 318 may be a ceramic part brazed to a lower side of the F-seal 316 for hot rolling.

The A-ceramic 317 may be installed at an upper end of the fifth-harmonic-frequency choke 315 and output high frequencies outward.

Specifically, the A-ceramic 317 may be brazed to an upper end of the fifth-harmonic-frequency choke 315, and the fourth-harmonic-frequency choke 335 for shielding a fourth harmonic frequency may be welded to an upper end of the A-ceramic 317. In some implementations, an antenna cap 324 for protecting the second-harmonic-frequency choke 319 may be installed at an upper end of the A-ceramic 317.

The third-harmonic-frequency choke 330 may be installed in the opening (OP) of the upper yoke 310*a* and be arranged at a lower side of the fifth-harmonic-frequency choke 315 so as to shield a third harmonic frequency.

Specifically, the third-harmonic-frequency choke 330 may extend in a heightwise direction on an axis the same as that of the bent part 315*a* and be arranged outside the bent part 315*a*.

The fourth-harmonic-frequency choke 335 may be bent inward and welded to the upper end of the A-ceramic 317 so as to shield the fourth harmonic frequency.

Specifically, one end of the fourth-harmonic-frequency choke 335 may be brazed to the A-ceramic 317 while the other end may be brazed to the second-harmonic-frequency choke 319. That is, the fourth-harmonic-frequency choke 335 may be a part that connects the A-ceramic 317 and the exhaust pipe (second-harmonic-frequency choke 319).

The second-harmonic-frequency choke 319 may be welded to the fourth-harmonic-frequency choke 335 and extend upward and downward along a heightwise direction so as to shield a second harmonic frequency.

Specifically, the second-harmonic-frequency choke 319 may be an exhaust pipe, and an upper end of the antenna (A) may be fixed to a top surface in the second-harmonic-frequency choke 319. In some implementations, the second-harmonic-frequency choke 319 may be brazed to the fourth-harmonic-frequency choke 335, and a length of the second-harmonic-frequency choke 319 in a heightwise direction may range from 14 mm to 16 mm but not is limited to what has been described.

In some implementations, bandwidth of the second-harmonic-frequency choke 319 may be greater than bandwidth of the fifth-harmonic-frequency choke 315, bandwidth of the fifth-harmonic-frequency choke 315 may be greater than bandwidth of the fourth-harmonic-frequency choke 335, and bandwidth of the fourth-harmonic-frequency choke 335 may be greater than bandwidth of the third-harmonic-frequency choke 330. Detailed description on this will be provided hereafter.

A magnetron 1 may have the above-described configurations and features. With reference to FIGS. 4 to 8, chokes of the magnetron 1 will be described in detail.

Figure 4:
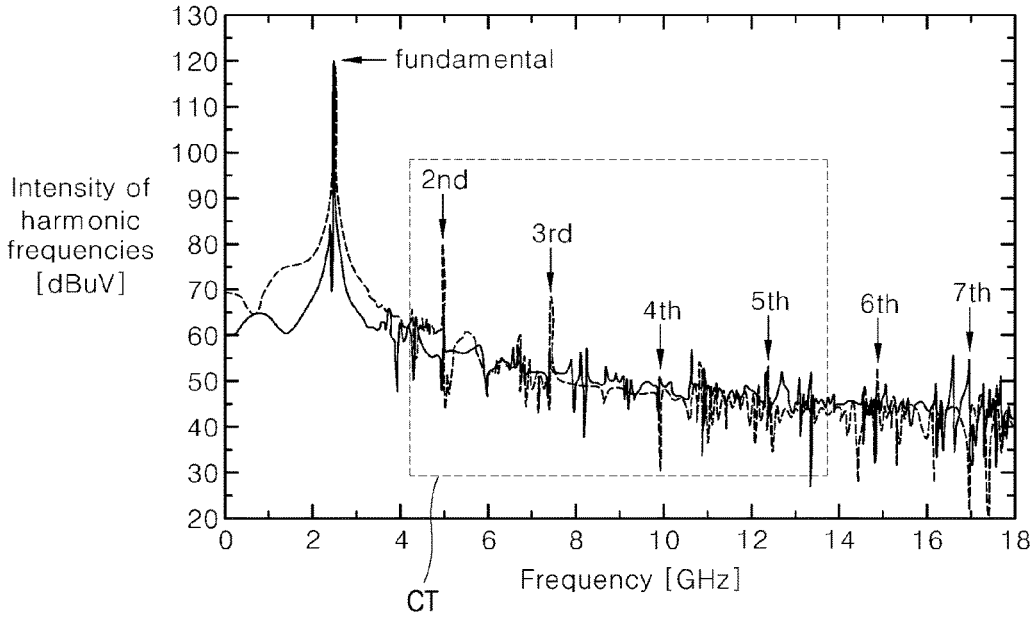
FIG. 4 is a graph showing example harmonic frequencies generated from the magnetron in FIG. 3.
Figure 5:
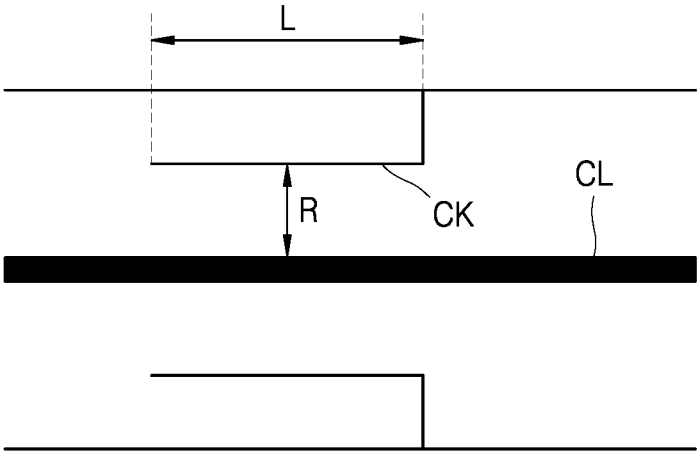
FIG. 5 is a schematic view showing an example choke and an example coaxial line that may affect frequencies to be shielded based on lengths of chokes and a distance between the choke and the coaxial line in FIG. 3.

FIG. 4 is a graph showing example harmonic frequencies generated from the magnetron in FIG. 3, FIG. 5 is a schematic view showing an example choke and an example coaxial line that may affect frequencies to be shielded based on lengths of chokes and a distance between the choke and the coaxial line in FIG. 3, and FIGS. 6 to 8 are schematic views showing example shielding performances of the chokes in FIG. 3.

With reference to FIG. 4, the magnetron 1 is a device for oscillating high frequencies of the fundamental frequency. Thus, the magnetron may generate harmonic frequencies (e.g. $2^{nd}$, $3^{rd}$, $4^{th}$, $5^{th}$, $6^{th}$, $7^{th}$ harmonic frequencies having frequencies twice, three times, four times, five times, six times, seven times that of the fundamental frequency.

However, the weaker the intensity (peak) of harmonic frequencies, the higher the ordinal number. The magnetron 1 shields only second to fifth harmonic frequencies ($2^{nd}$, $3^{rd}$, $4^{th}$, $5^{th}$ harmonic frequencies) with chokes (319, 330, 335, and 315 in FIG. 3). The second to fifth harmonic frequencies ($2^{nd}$, $3^{rd}$, $4^{th}$, $5^{th}$ harmonic frequencies) may be harmonic frequencies (CT) to be shielded by the magnetron 1.

In some implementations, the size limitations of the second to fourth harmonic frequencies ($2^{nd}$, $3^{rd}$, $4^{th}$ harmonic frequencies) may be 92 dBuV/m, and the size limitations of the fifth harmonic frequency ($5^{th}$ harmonic frequency) may be 73 dBuV/m. That is, the size limitations of the second to fourth harmonic frequencies ($2^{nd}$, $3^{rd}$, $4^{th}$ harmonic frequencies) are the same. However, the second harmonic frequency ($2^{nd}$ harmonic frequency) generally has the greatest size among the three harmonic frequencies. Thus, the second harmonic frequency has to be strongly shielded.

FIG. 5 shows an example of the structures and theories of chokes for shielding harmonic frequencies.

Specifically, harmonic frequencies may be shielded in the magnetron 1 by means of changes in a coaxial structure, and the coaxial structure may be determined on the basis of a distance (R) between a choke (CK, e.g. any one of 319, 330, 335, 315 in FIG. 3) and a coaxial line (CL) and on the basis of a length (L) of a choke (CK)—i.e. a length of a choke (CK) extending along a direction parallel to a coaxial line (CL)) or a "length in the heightwise direction".

In some implementations, the coaxial line (CL) may denote a line corresponding to a central axis of the magnetron 1.

In some implementations, when a distance (R) between a choke (CK) and a coaxial line (CL) becomes shorter and a length (L) of a choke (CK) becomes longer, frequencies to be shielded may become lower. Further, when the center frequency of a choke (CK) is exactly matched (accord) with) the frequency of a harmonic frequency to be shield, the choke may excellently shield harmonic frequencies.

Accordingly, when a distance (R) between a choke (CK) and a coaxial line (CL) is shorter than that between the other chokes and the coaxial line, and a length (L) of the second-harmonic-frequency choke (CK) is longer than that of the other chokes, the second harmonic frequency, the lowest frequency, may be shielded. That is, spare space for the second-harmonic-frequency choke is required so as to properly shield the second harmonic frequency.

For this reason, a second-harmonic-frequency choke (CK2) of a magnetron (ref. FIG. 1) in related art is hardly lengthened because of a short distance between the second-harmonic-frequency choke (CK2) and the antenna feeder (AF). Accordingly, the shielding of the second-harmonic-frequency choke (CK2) is limited.

In some examples, the positions of the second and third harmonic frequency chokes of a magnetron (1 in FIG. 3) are changed compared to those of the second and third harmonic frequency chokes of the magnetron in related art. That is, in some example, when lengthened, the second-harmonic-frequency choke 319 of the magnetron (1 in FIG. 3) does not contact the antenna feeder (AF). In some implementations, a distance between the second-harmonic-frequency choke 319 and the coaxial line (CL) in the magnetron (1 in FIG. 3) is shorter than that of the conventional magnetron. Accordingly, the center frequency of the second-harmonic-frequency choke 319 is easily matched with the frequency to be shielded (i.e. frequency of the second harmonic frequency), and the shielding of the second-harmonic-frequency choke 319 can improve.

Figure 6:
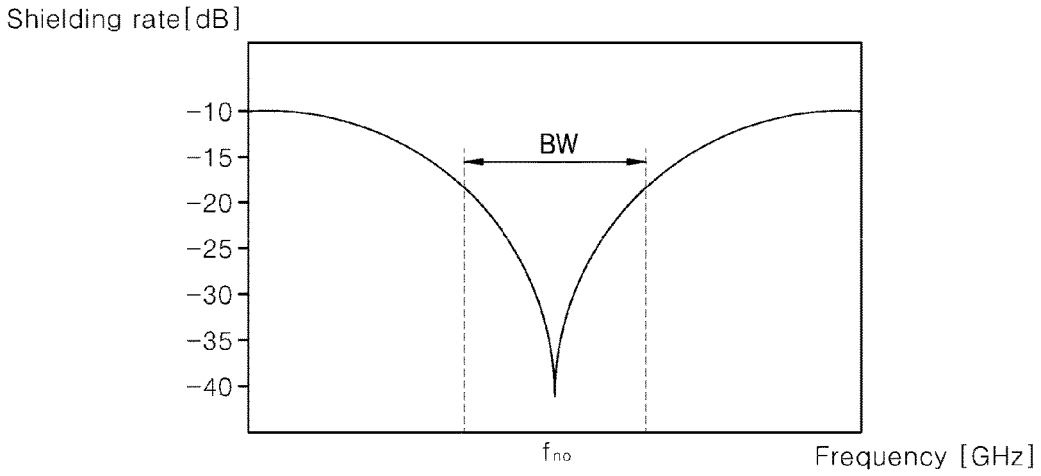
FIGS. 6 to 8 are schematic views showing example shielding performances of the choke in FIG. 3.

FIG. 6 shows changes in shielding rates depending on the frequency of a choke.

Specifically, the shielding rate of a choke (e.g. any one of 319, 330, 335, and 315 in FIG. 3) may vary depending frequencies.

As shown in the drawing, the shielding rate of a choke is highest at the center frequency (fno) of the choke. Accordingly, when the center frequency of a choke is matched (accord) with the frequency to be shield, the choke performs an excellent shielding function.

In some implementations, when the bandwidth (BW) of a choke becomes wider, the choke may perform better shielding functions. This is because wider bandwidth (BW) of a choke leads to a wider range of frequency shielded by the choke.

Figure 7:
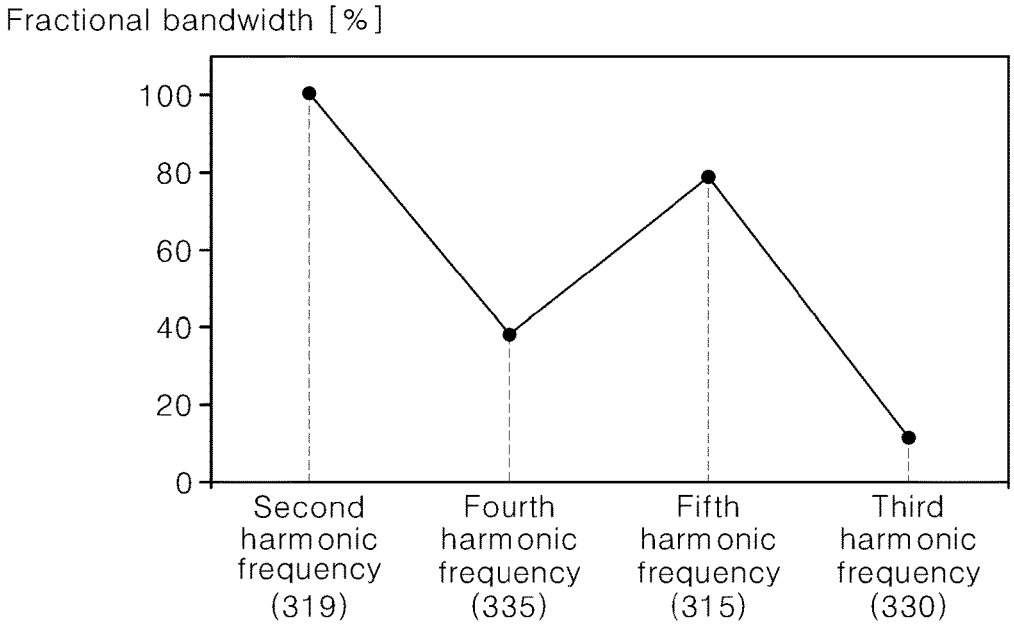

Considering the shielding of such a choke, bandwidth of the second-harmonic-frequency choke 319 may be greater than bandwidth of the fifth-harmonic-frequency choke 315, bandwidth of the fifth-harmonic-frequency choke 315 may be greater than bandwidth of the fourth-harmonic-frequency choke 335, and bandwidth of the fourth-harmonic-frequency choke 335 may be greater than bandwidth of the third-harmonic-frequency choke 330, as shown in FIG. 7.

That is, when having the greatest bandwidth among the harmonic frequency chokes, the second-harmonic-frequency choke 319 may perform the best possible shielding function and properly shield the second harmonic frequency.

In some examples, a graph of fractional bandwidth in FIG. 7 may be the size of a relative bandwidth of each choke on the basis of the shielding of the second-harmonic-frequency choke 319.

Figure 8:
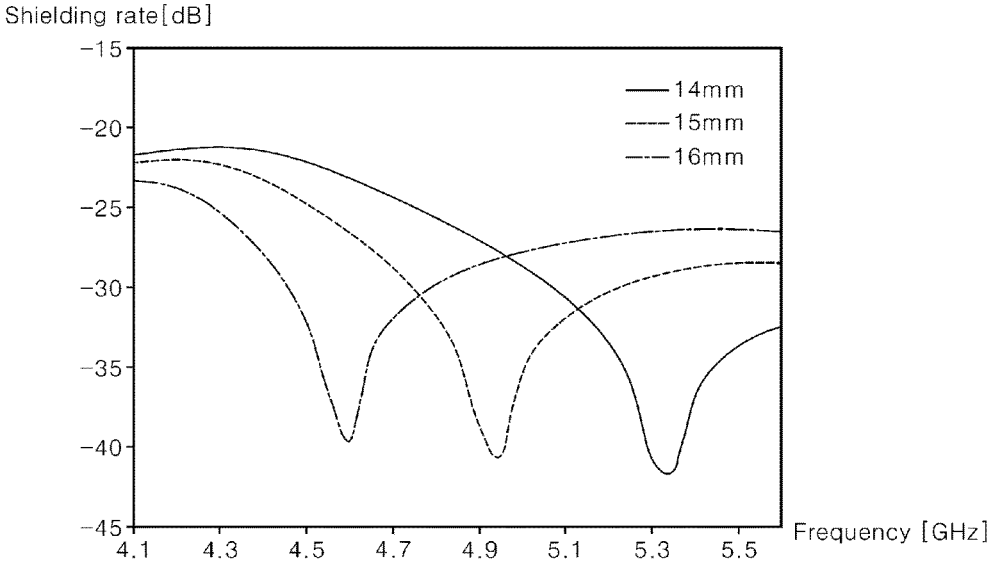

FIG. 8 shows changes in a shielded frequency on the basis of a length of a choke (a length (L) of a choke in the direction of the coaxial line (CL) in FIG. 5).

Specifically, if the choke in FIG. 8 is the second-harmonic-frequency choke (319 in FIG. 3), a graph of a shielded frequency is changed depending on a length of the second-harmonic-frequency choke.

For instance, if the length of the second-harmonic-frequency choke is 14 mm, the center frequency of the second-harmonic-frequency choke may be 5.3 GHz, the length of the second-harmonic-frequency choke is 15 mm, the center frequency of the second-harmonic-frequency choke may be 4.9 GHz, and the length of the second-harmonic-frequency choke is 16 mm, the center frequency of the second-harmonic-frequency choke may be 4.6 GHz.

As shown in FIG. 4, when the length of the second-harmonic-frequency choke is 15 mm, the center frequency of the second-harmonic-frequency choke may be well matched with the frequency of the second harmonic frequency because the frequency of the second harmonic frequency is about 4.9 GHz. Further, when the length of the second-harmonic-frequency choke is 15 mm, the rate at which the second harmonic frequency is shielded in 4.9 GHz is −40.6 dB, which is higher than the rate of −28.3 dB when the length is 14 mm and the rate of −28.2 dB when the length is 16 mm.

Considering the shielding of such a choke, the length of the second-harmonic-frequency choke 319 in FIG. 3 may be 15 mm so that the second-harmonic-frequency choke can optimally shield the second harmonic frequency. However, the length is not limited to such a figure. That is, even when the length of the second-harmonic-frequency choke 319 is 14 mm or 16 mm, there is enough margin for the size limitations of the second harmonic frequency. Accordingly, the length of the second-harmonic-frequency choke 319 may range from 14 mm to 16 mm.

In some implementations, the length of the second-harmonic-frequency choke 319 may change depending on its relationship with other elements during manufacturing.

That is, the center frequency of the second-harmonic-frequency choke 319 is matched with the frequency of the second harmonic frequency by means of changes in the length of the second-harmonic-frequency choke 319 so that the shielding of the second-harmonic-frequency choke 319 can improve, thereby making it possible to properly shield the strongest second harmonic frequency.

As described above, a magnetron 1 may excellently shield the second harmonic frequency stronger than the other harmonic frequencies by means of an arrangement of chokes different from that of conventional magnetrons. Further, a magnetron with an improved function of shielding harmonic frequencies may operate more reliably.

In some implementations, a magnetron 1, in which the positions of a second-harmonic-frequency choke and a third-harmonic-frequency choke are exchanged unlike a conventional magnetron, may be prevented from a short circuit and spark caused by a short distance between a choke and an antenna feeder. Further, in fact, rework (additional work) and an increase in the fraction defective, caused by the interference between a choke and an antenna feeder, may be prevented during manufacturing.

Another example magnetron will be described below with reference to FIG. 9.

Figure 9:
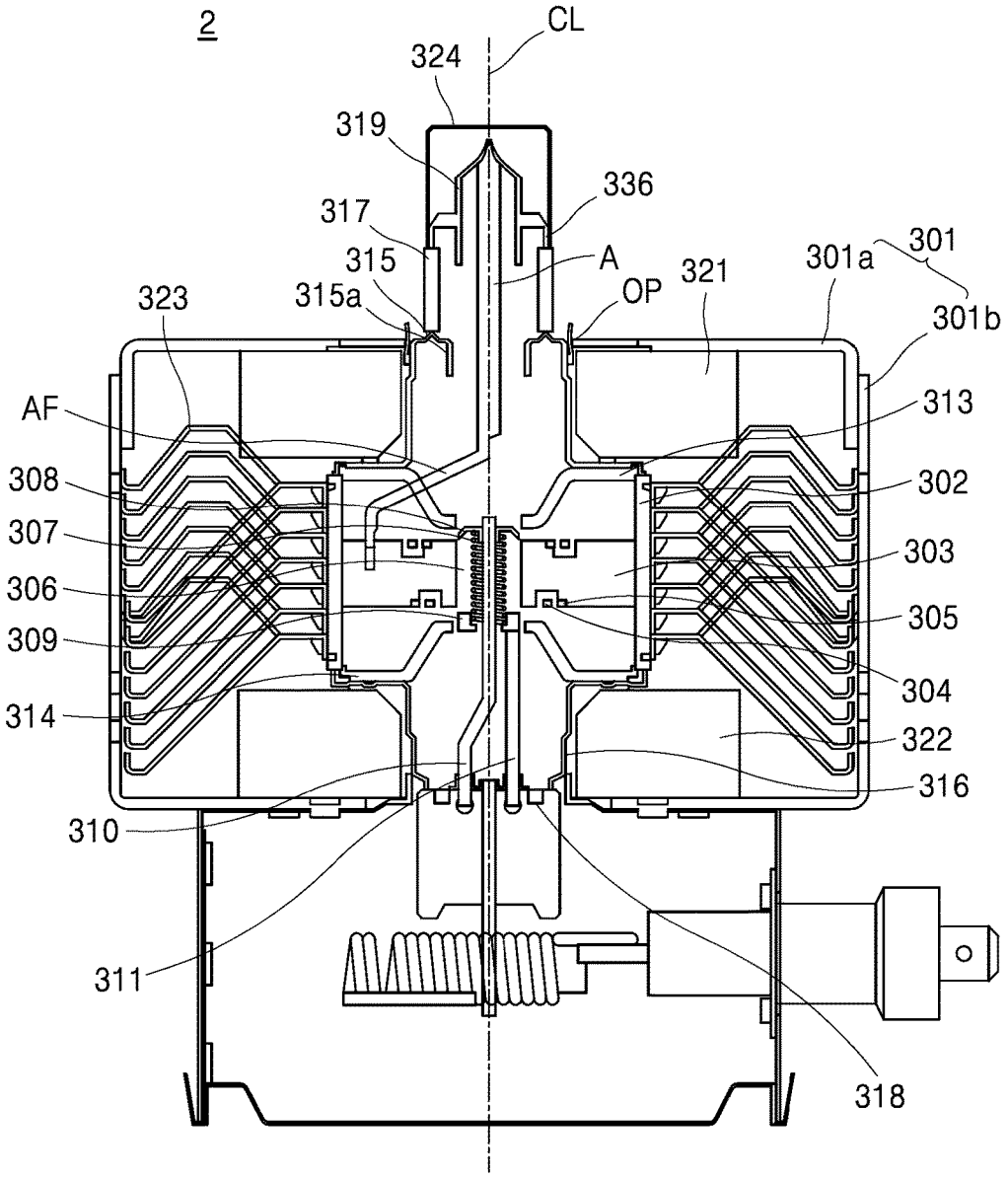
FIG. 9 is a sectional view showing another example magnetron according to the present disclosure.

FIG. 9 is a sectional view showing another example magnetron according to the present disclosure.

The magnetron 2 in FIG. 9 is the same as the magnetron 1 in FIG. 3 except for some configurations. Differences between the magnetrons will be described.

In some implementations, a magnetron 2 may include a yoke 301, an upper magnet 321, a lower magnet 322, an anode cylinder 320, an upper pole piece 313, a lower pole piece 314, an A-ceramic 317, a second-harmonic-frequency choke 319, a third-harmonic-frequency choke 336, a fifth-harmonic-frequency choke 315, an antenna cap 324, a plurality of vanes 303, an antenna (A), an antenna feeder (AF) and the like, with reference to FIG. 9.

That is, the magnetron 2 in FIG. 9 may not include a fourth-harmonic-frequency choke unlike the magnetron 1 in FIG. 3.

In some implementations, the magnetron 2 may not include a choke for shielding the weakest (smallest) fourth harmonic frequency among the second, third and fourth harmonic frequencies, which requires less shielding than the second and third harmonic frequencies. Thus, costs of manufacturing the magnetron may be reduced. In some implementations, in the magnetron 2, the third-harmonic-frequency choke 336 may be arranged at the position (335 in FIG. 3) of the fourth-harmonic-frequency choke of the magnetron 1, and the second 319 and fifth 315 harmonic frequency chokes may be arranged respectively at the same positions as the second and fifth harmonic frequency chokes of the magnetron 1. In some implementations, bandwidth of the second-harmonic-frequency choke 319 may be greater than bandwidth of the fifth-harmonic-frequency choke 315, and bandwidth of the fifth-harmonic-frequency choke 315 may be greater than bandwidth of the third-harmonic-frequency choke 336. However, the bandwidth is not limited what has been described.

In some implementations, a magnetron 2 may meet standards of the second, third, fourth and fifth harmonic frequencies even in the absence of the fourth-harmonic-frequency choke.

The above-described present disclosure may be replaced, changed and modified by one having ordinary skill in the art to which the present disclosure pertains within the technical spirit of the disclosure. Therefore, the present disclosure should not be construed as being limited to the description and the attached drawings.

What is claimed is:

1. A magnetron comprising:

a yoke that defines an accommodating space and that defines a yoke opening at an upper portion of the yoke;

an upper magnet located in the accommodating space and coupled to an inner surface of the upper portion of the yoke along a widthwise direction of the yoke;

an upper pole piece that has a funnel shape and that is located at a lower side of the upper magnet;

a fifth-harmonic-frequency choke that is located in the yoke opening, that is located at an upper side of the upper pole piece, and that is configured to block a fifth harmonic frequency from an electromagnetic wave;

a third-harmonic-frequency choke that is located in the yoke opening, that is located at a lower side of the fifth-harmonic-frequency choke, and that is configured to block a third harmonic frequency from the electromagnetic wave;

a ceramic part located at an upper end of the fifth-harmonic-frequency choke and configured to output the electromagnetic wave including a plurality of frequencies;

a fourth-harmonic-frequency choke that is bent inward from the ceramic part, that is welded to an upper end of the ceramic part, and that is configured to block a fourth harmonic frequency from the electromagnetic wave; and a second-harmonic-frequency choke that is welded to the fourth-harmonic-frequency choke, that extends upward and downward along a heightwise direction, and that is configured to block a second harmonic frequency from the electromagnetic wave.

2. The magnetron according to claim 1, wherein the yoke comprises an upper yoke that defines the yoke opening, and a lower yoke that is coupled to the upper yoke, and wherein the upper yoke and the lower yoke define the accommodating space based on being coupled to each other.

3. The magnetron according to claim 2, further comprising:

a lower magnet accommodated in the accommodating space and coupled to an inner surface of the lower yoke along the widthwise direction of the yoke, wherein the upper magnet is coupled to an inner surface of the upper yoke.

4. The magnetron according to claim 3, further comprising:

an anode cylinder that has an upper opening and a lower opening, that is located in a space between the upper magnet and the lower magnet, and that is configured to generate high-frequency energy;

a lower pole piece that has a funnel shape and that is located at an upper side of the lower magnet; and an antenna cap located at the upper end of the ceramic part, wherein the upper pole piece is located at the upper opening of the anode cylinder, and the lower pole piece is located at the lower opening of the anode cylinder.

5. The magnetron according to claim 2, further comprising:

an anode cylinder located in the yoke;

a plurality of vanes radially that are arranged in the anode cylinder and that defines a cavity resonator configured to induce a high-frequency component of the electromagnetic wave; and an antenna located at the fifth-harmonic-frequency choke and configured to, based on oscillation of the electromagnetic wave in the cavity resonator, output the electromagnetic wave including the plurality of frequencies.

6. The magnetron according to claim 5, wherein the antenna has:

a lower end connected to one of the plurality of vanes; and an upper end fixed to an inner surface of an upper portion of the second-harmonic-frequency choke.

7. The magnetron according to claim 1, wherein the fifth-harmonic-frequency choke comprises a bent part that is bent inward from an upper end of the fifth-harmonic-frequency choke and that extends downward along the heightwise direction.

8. The magnetron according to claim 7, wherein the third-harmonic-frequency choke extends along the heightwise direction, is coaxial with the bent part, and is arranged outside of the bent part.

9. The magnetron according to claim 1, wherein the ceramic part is brazed to the upper end of the fifth harmonic frequency choke, wherein the fourth-harmonic-frequency choke is brazed to the ceramic part, and wherein the second-harmonic-frequency choke is brazed to the fourth-harmonic-frequency choke.

10. The magnetron according to claim 1, wherein:

the third-harmonic-frequency choke is configured to block a third bandwidth of frequency;

the fourth-harmonic-frequency choke is configured to block a fourth bandwidth of frequency that is greater than the third bandwidth;

the fifth-harmonic-frequency choke is configured to block a fifth bandwidth of frequency that is greater than the fourth bandwidth; and the second-harmonic-frequency choke is configured to block a second bandwidth of frequency that is greater than the fifth bandwidth.

11. The magnetron according to claim 1, wherein a length of the second-harmonic-frequency choke is in a range from 14 mm to 16 mm in the heightwise direction.

12. The magnetron according to claim 1, wherein the plurality of frequencies include a fundamental frequency that is a half of the second harmonic frequency.

13. The magnetron according to claim 12, wherein the third harmonic frequency is three times of the fundamental frequency, the fourth harmonic frequency is four times of the fundamental frequency, and the fifth harmonic frequency is five times of the fundamental frequency.

14. The magnetron according to claim 1, wherein a lower end of the third-harmonic-frequency choke is located vertically above a lower end of the upper magnet.

15. The magnetron according to claim 1, wherein a length of the third-harmonic-frequency choke is less than a length of the upper magnet in the heightwise direction.

16. The magnetron according to claim 3, wherein a length of the third-harmonic-frequency choke is less than a length of the lower magnet in the heightwise direction.

17. A magnetron comprising:

a yoke that defines an accommodating space and that defines a yoke opening at an upper portion of the yoke;

an upper magnet located in the accommodating space and coupled to an inner surface of the upper portion of the yoke along a widthwise direction of the yoke;

an upper pole piece that has a funnel shape and that is located at a lower side of the upper magnet;

a fifth-harmonic-frequency choke that is located in the yoke opening, that is located at an upper side of the upper pole piece, and that is configured to block a fifth harmonic frequency from an electromagnetic wave;

a ceramic part located at an upper end of the fifth-harmonic-frequency choke and configured to output the electromagnetic wave including a plurality of frequencies;

a third-harmonic-frequency choke that is bent inward from the ceramic part, that is welded to an upper end of the ceramic part, and that is configured to block a third harmonic frequency from the electromagnetic wave; and a second-harmonic-frequency choke that is welded to the third-harmonic-frequency choke, that extends upward and downward along a heightwise direction, and that is configured to block a second harmonic frequency from the electromagnetic wave.

18. The magnetron according to claim 17, wherein:

the third-harmonic-frequency choke is configured to block a third bandwidth of frequency;

the fifth-harmonic-frequency choke is configured to block a fifth bandwidth of frequency that is greater than the third bandwidth; and the second-harmonic-frequency choke is configured to block a second bandwidth of frequency that is greater than the fifth bandwidth.

19. The magnetron according to claim 17, wherein the plurality of frequencies include a fundamental frequency that is a half of the second harmonic frequency.

20. The magnetron according to claim 19, wherein the third harmonic frequency is three times of the fundamental frequency, and the fifth harmonic frequency is five times of the fundamental frequency.

* * * * *